United States Patent [19]

Halberg et al.

[11] Patent Number: 4,783,191

[45] Date of Patent: Nov. 8, 1988

[54] NOZZLE CHAMBER SYSTEM FOR A STEAM TURBINE

[75] Inventors: Walter Halberg; George W. Y. Chang, both of Casselberry, Fla.; David M. Parker, Steele Creek, N.C.

[73] Assignee: Westinghouse Electric Corp., Pittsburgh, Pa.

[21] Appl. No.: 39,822

[22] Filed: Apr. 15, 1987

Related U.S. Application Data

[63] Continuation of Ser. No. 765,736, Aug. 14, 1985, abandoned.

[51] Int. Cl.[4] ..... F01D 25/26

[52] U.S. Cl. ..... 415/136; 415/219 R

[58] Field of Search ..... 415/134–139, 415/219 R, 182, 183, 185; 403/28, 29

[56] References Cited

U.S. PATENT DOCUMENTS

| | | | |
|---|---|---|---|
| 2,527,445 | 10/1950 | Pentheny | 415/138 |
| 2,925,995 | 2/1960 | Hertl | 415/138 |
| 3,544,233 | 12/1970 | Brown et al. | 415/219 R |
| 3,754,833 | 8/1973 | Remberg | 415/134 X |
| 3,892,500 | 7/1975 | Miller et al. | 415/219 R |
| 3,907,308 | 9/1975 | Stock | 415/138 X |
| 4,078,812 | 3/1978 | Beckershoff | 415/139 X |
| 4,362,464 | 12/1982 | Stock | 415/219 R X |

*Primary Examiner*—Robert E. Garrett
*Assistant Examiner*—Joseph M. Pitko
*Attorney, Agent, or Firm*—F. J. Baehr, Jr.

[57] ABSTRACT

A nozzle chamber assembly comprising an upper nozzle chamber resting on a lower nozzle chamber wherein the nozzle chambers are neither bolted nor pinned at their horizontal juncture but are held together by gravitational and pressure forces. A removable bolt which passes through the upper portion of the inner cylinder during assembly of the turbine and threads into the upper portion of the nozzle chamber to fasten the upper nozzle chamber in the upper portion of the inner cylinder during assembly and is removable once the inner cylinder is assembled. The inlet nozzles for the turbine and nozzle chambers are slidably received and sealed in a common bore which extends through the inner cylinder.

8 Claims, 3 Drawing Sheets

NOZZLE CHAMBER SYSTEM FOR A STEAM TURBINE

This application is a continuation of application Ser. No. 765,736 filed Aug. 14, 1985 now abandoned.

BACKGROUND OF THE INVENTION

This invention relates to steam turbines and more particularly to a nozzle chamber system therefor. Previously nozzle chambers were made as an integral part of the inner cylinder being welded at the inlet end to a flexible neck on the inlet cylinder. For each arc of admission there was an individual chamber segment cantilevered from the inlet barrel weld joint. The cantilevered portion was otherwise constrained only in the turbine axial direction by tongue and groove fits. There was no additional constraint in the other directions. In these turbines the inlet sleeve was installed in a bore in the nozzle chamber barrel where sealing was accomplished by a bell seal as shown in U.S. Pat. No. 3,907,308. For reasons not fully understood the nozzle chambers and inlet sleeve have experienced significant vibration excitation. It has been postulated that inadequate constraint of the nozzle chamber has contributed to excessive wear in the tonque and groove fits allowing increasingly larger vibrational amplitudes sometimes resulting in high cycle fatigue cracking at the weld neck. There is also some reason to believe that the mating of the inlet sleeve into the nozzle chamber barrel may have caused vibratory interaction which could have contributed to the fatigue of the inlet sleeve on the nozzle chamber neck. Other manufacturers have used two nozzle chambers as disclosed herein, but the upper and lower halves were normally bolted or pinned at the horizontal joint.

SUMMARY OF THE INVENTION

In general a nozzle chamber assembly for a steam turbine having a horizontally split inner and outer cylinder forming upper and lower halves thereof, when made in accordance with this invention, comprises separate upper and lower nozzle chambers each having a plurality of separate cavities disposed therein with an inlet nozzle for each separate cavity. The inner cylinder of the turbine has a plurality of generally cylindrical openings disposed to slidably receive the inlet nozzles of the cavities and means disposed in the cylindrical openings for forming a slidable seal between the cylindrical openings and the inlet nozzles of the cavities. The assembly also comprises axial locking means cooperatively associated with the lower nozzle chamber and the lower half of the inner cylinder to essentially fix the axial position of the lower nozzle chamber with respect to the lower half of the inner cylinder adjacent the axial locking means, lateral locking means cooperatively associated with the lower nozzle chamber and the lower half of the inner cylinder to essentially fix the lateral position of the lower nozzle chamber with respect to the lower half of the inner cylinder adjacent the locking means, axial locking means cooperatively associated with the upper nozzle chamber and the upper half of the inner cylinder to essentially fix the axial position of the upper nozzle chamber with respect to the upper half of the inner cylinder adjacent the axial locking means, and lateral locking means cooperatively associated with the upper nozzle chamber and the upper half of the inner cylinder to essentially fix the lateral position of the upper nozzle chamber with respect to the upper cylinder adjacent the lateral locking means, whereby though fixed with respect to the inner cylinder both axially and laterally the upper and lower nozzle chambers are free to expand with respect to each other and with respect to the inner cylinder.

BRIEF DESCRIPTION OF THE DRAWINGS

The objects and advantages of this invention will become more apparent by reading the following detail description in conjunction with the accompanying drawings, in which.

DESCRIPTION OF THE PREFERRED EMBODIMENT

Figure 1:
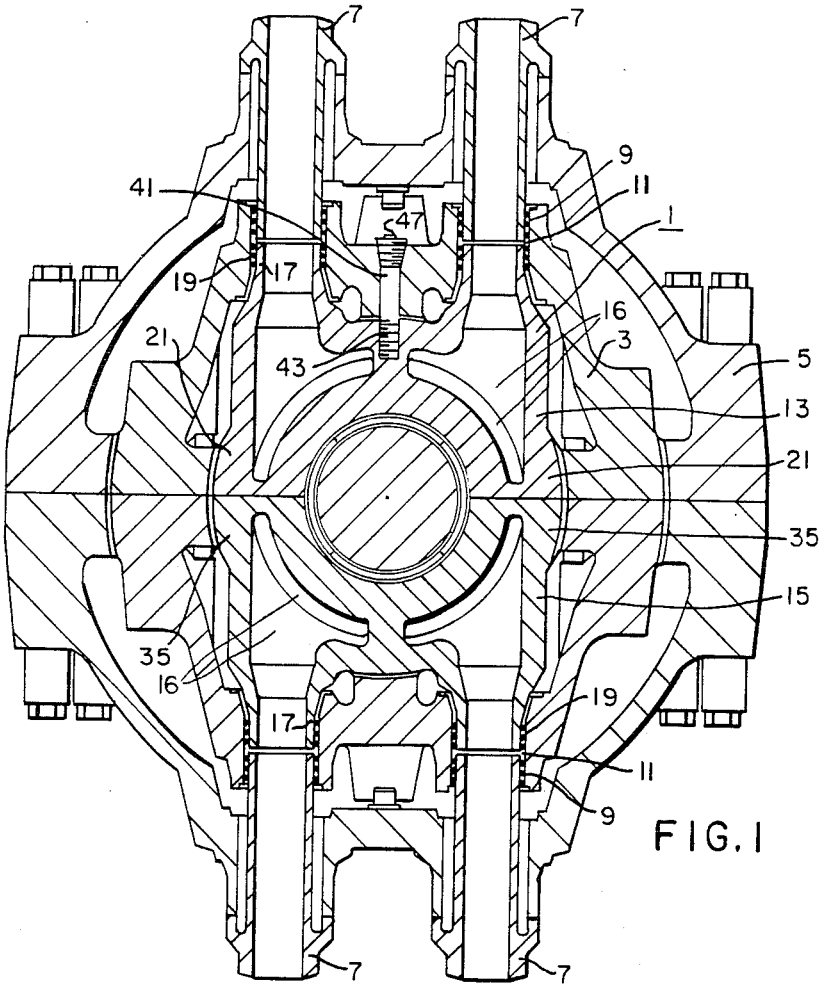
FIG. 1 is a sectional view of a steam turbine and nozzle chamber assembly made in accordance with this invention.

Referring now to the drawings in detail and in particular to FIG. 1 there is shown a steam turbine and nozzle chamber assembly 1 disposed within an inner and outer casing or cylinder 3 and 5, respectively. The inner and outer cylinders 3 and 5 are split horizontally forming upper and lower halves thereof, which are bolted together. The outer cylinder 5 has a plurality of inlet sleeves or nozzles 7 extending therethrough. The radially inner ends of the inlet nozzles 7 have a plurality of circumferential grooves which are adapted to receive piston rings or pressure seal rings 9 for forming a slidable seal.

The inner cylinder 3 has a plurality of generally cylindrical openings or bores 11 adapted to slidably receive the radially inner ends of the inlet nozzle 7 and seal rings 9 and cooperate therewith to form a pressure-tight slidable seal between the inlet nozzles 7 and the cylindrical openings 11.

The nozzle chamber assembly 1 comprises upper and lower nozzle chambers 13 and 15, respectively, each of which has a plurality of separate cavities 16 disposed therein. Each cavity has an inlet nozzle 17 with a plurality of circumferential grooves on its outer surface and piston rings or pressure seal rings 19 for forming a pressure-tight seal disposed within the grooves. The inlet nozzles 17 are slidably received by the cylindrical opening 11 in the inner cylinder 3 and cooperate with the seal rings 19 to form a pressure-tight seal therebetween.

The upper nozzle chamber 13 sits on the lower nozzle chamber 15 without any fastening therebetween so that they are free to move with respect to each other. The only thing holding the nozzle chambers together are pressure and gravitational forces.

The upper nozzle chamber 13 has three lugs disposed thereon, two side lugs 21 and an upper lug 23, each of which extends radially outwardly from the upper nozzle chamber 13. Each of the lugs has a circumferential oriented groove 25, which cooperates with a tongue or key 27 extending radially inwardly from the upper half of the inner cylinder 3 to axially fix or lock the upper nozzle chamber 13 axially within the inner cylinder 3.

Figure 5:
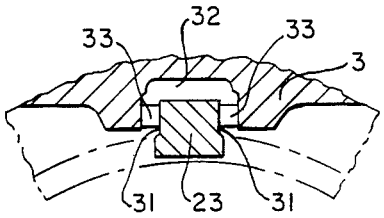
FIG. 5 is a partial sectional view of an interlock between the nozzle chamber and the inner cylinder.

As shown best in FIG. 5 the upper lug 23 also has a pair of parallel axially oriented sides 31 which are received by an axially oriented groove 32 in the inner cylinder 3. The groove 32 in the inner cylinder has wear plates 33 which engage the sides 31 of the lug 23 to laterally fix or lock the upper nozzle chamber 13 within the inner cylinder 3.

The lower nozzle chamber 15 has three lugs disposed thereon, two side lugs 35 and a bottom or lower lug 37, each of which extends radially outwardly from the lower nozzle chamber 15. Each lug has a circumferentially oriented groove 25 which cooperates with a tongue or key 27 extending radially inwardly from the lower half of the inner cylinder 3 to axially fix or lock the lower nozzle chamber 15 axially within the inner cylinder 3. The lower lug 37 also has a pair of parallel axially oriented sides 31 which are received by an axially oriented groove 32 in the inner cylinder which has wear plates 33 which engage the sides 31 of the lugs 37 to laterally fix or lock the lower nozzle chamber 15 with respect to the inner cylinder 3.

The lugs and keys are so disposed that even though the nozzle chambers are fixed with respect to the inner cylinder adjacent the lugs, both axially and laterally, the nozzle chambers are able to expand during periods of rapid temperature change relative to the inner cylinder and since the upper and lower nozzle chambers are not fastened together they are free to expand relative to each other when one portion of the nozzle assembly is subjected to rapid temperature changes, for example during start-up, to significantly reduce the potential of high temperature stresses in the nozzle chamber assembly.

Figure 1A:
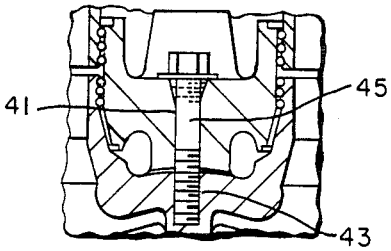
FIG. 1A is a partial sectional view showing a bolt used for assembly of the inner cylinder.
Figure 2:
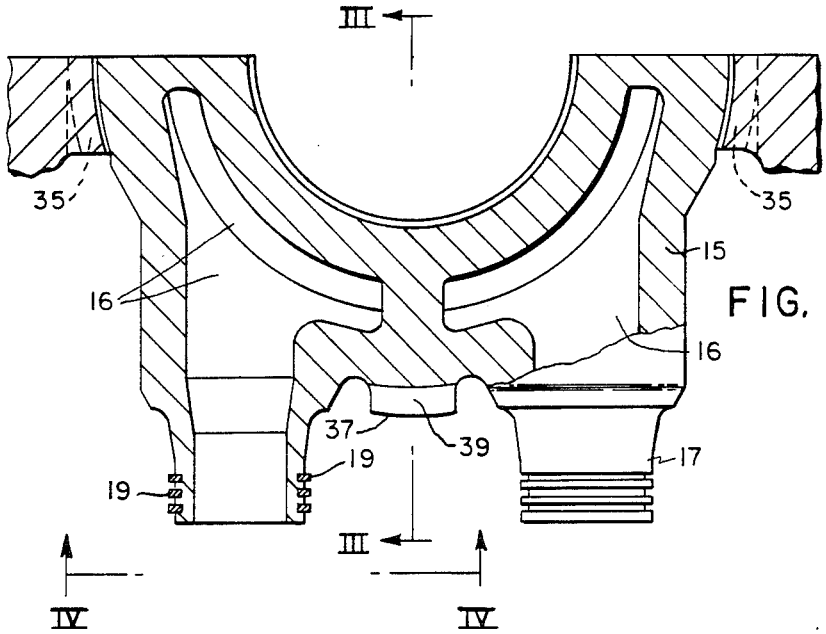
FIG. 2 is an elevational view of a nozzle chamber.
Figure 4:
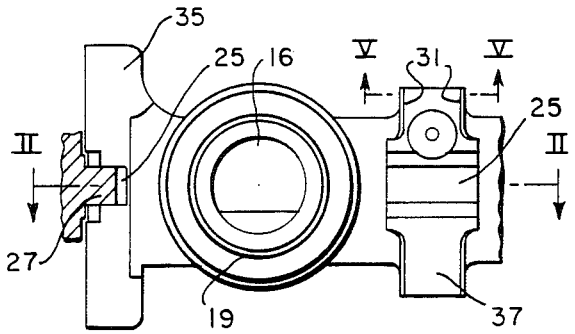
FIG. 4 is a sectional view taken on line IV—IV of FIG. 2.
Figure 3:
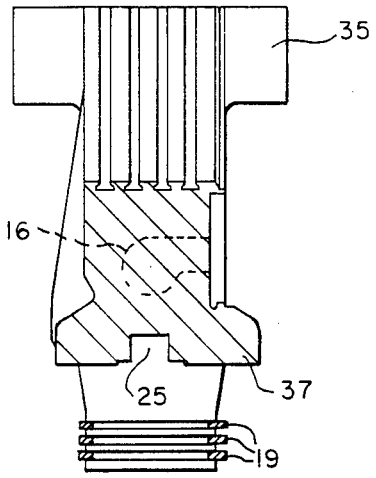
FIG. 3 is a sectional view taken on line III—III of FIG. 2.

As shown in FIGS. 1 and 1A, to provide for assembly of the turbine, the upper half of the inner cylinder 3 has a tapered tapped through hole 41 disposed therein. The upper nozzle chamber 13 has a straight tapped blind hole 43 disposed therein. The hole 41 in the inner cylinder is larger in diameter than the hole 43 and registers therewith so that a bolt 45 can fit through the hole 41 and engage the threads in the hole 43 to hold the upper nozzle chamber 13 in the upper portion of the inner cylinder 3 during assembly of the turbine. Once the inner cylinder 3 is assembled the bolt 45 is removed and a pipe plug 47 is utilized to seal the hole 41 in the upper portion of the inner cylinder 3.

The nozzle chamber assembly hereinbefore described advantageously eliminates the possible vibratory interactions that may have occurred from the prior practice of sealing the inlet sleeve at the nozzle chamber bore and provides for free expansion of the nozzle chambers.

What is claimed is:

1. A nozzle chamber assembly for a steam turbine having horizontally split inner and outer cylinders each having upper and lower halves, said nozzle chamber assembly comprising unconnected upper and lower nozzle chambers, each having at least one cavity and an inlet nozzle in fluid communication with each cavity;

said nozzle chamber inlet nozzles each having a plurality of circumferential grooves disposed on the distal end thereof;

said inner cylinder having a plurality of cylindrical openings of essentially constant diameter for sealably receiving said nozzle chamber inlet nozzles;

said outer cylinder having a plurality of inlet nozzles which extend through said outer cylinder and are sealably received by said essentially constant diameter cylindrical opening in said inner cylinder;

each outer cylinder inlet nozzle having an inner distal end spaced from the distal end of an associated nozzle chamber inlet nozzle;

said outer cylinder inlet nozzles having a plurality of circumferential grooves adjacent the distal ends thereof;

ring sealing means disposed in said nozzle chamber and said outer cylinder inlet nozzle circumferential grooves to form a pressure tight seal between said inlet nozzle and said cylindrical openings in said inner cylinder whereby the only thing holding the nozzle chambers together are pressure and gravitational forces so they are free to move with respect to each other providing free expansion and eliminating possible vibratory interactions between the nozzle chambers; and locking means cooperatively associated with each of said nozzle chambers and said inner cylinder to fix each nozzle chamber with respect to the inner cylinder and the axis of the turbine and to allow each nozzle chamber to expand and contract completely independent of the other.

2. A nozzle chamber assembly as set forth in claim 1, wherein the locking means includes:

lower axial locking means cooperatively associated with said lower nozzle chamber and said lower half of said inner cylinder to essentially fix the axial position of said lower nozzle chamber with respect to said lower half of said inner cylinder adjacent said axial locking means;

lower lateral locking means cooperatively associated with said lower nozzle chamber and said lower half of said inner cylinder to essentially fix the lateral position of said lower nozzle chamber with respect to the lower half of said inner cylinder adjacent said lateral locking means;

upper axial locking means cooperatively associated with said upper nozzle chamber and said upper half of said inner cylinder to essentially fix the axial position of said upper nozzle chamber with respect to said upper half of said inner cylinder adjacent said axial locking means;

upper lateral locking means cooperatively associated with the upper nozzle chamber and said upper half of said inner cylinder to essentially fix the lateral position of said upper nozzle chamber with respect to the upper half of said inner cylinder adjacent said lateral locking means;

whereby though fixed with respect to the inner cylinder both axially and laterally the upper and lower nozzle chambers are free to expand with respect to each other and with respect to the inner cylinder.

3. A nozzle chamber assembly as set forth in claim 2, wherein the lower and upper axial locking means comprise a plurality of lugs extending radially outwardly from said nozzle chambers and each lug has a circumferentially extending groove which receives a tongue extending radially inwardly from the inner cylinder.

4. A nozzle chamber assembly as set forth in claim 3, wherein the lower and upper lateral locking means comprise a lug having axially oriented parallel sides which are received by an axially oriented groove in the inner cylinder.

5. A nozzle chamber assembly as set forth in claim 4, wherein each nozzle chamber has three lugs disposed thereon, one on each side of each nozzle chamber, the lower chamber having one lug extending from the lower portion thereof and the upper nozzle chamber having one lug extending from the upper portion thereof.

6. A nozzle chamber assembly as set forth in claim 5, wherein the upper and lower lugs respectively disposed on the upper and lower nozzle chambers have the lateral locking means disposed thereon.

7. A nozzle chamber assembly as set forth in claim 2 and further comprising means for fastening said upper nozzle chamber to said upper portion of said inner cylinder during assembly of said steam turbine.

8. A nozzle chamber assembly as set forth in claim 7 wherein the fastening means comprises bolt holes in said inner cylinder and upper nozzle chamber, a bolt which is removable and a plug for sealing the bolt hole in the inner cylinder when the bolt is removed after assembly.

* * * * *